US009265289B1

(12) United States Patent
Green, Jr. et al.

(10) Patent No.: US 9,265,289 B1
(45) Date of Patent: Feb. 23, 2016

(54) LONG SLEEVE TO SHORT SLEEVE ON PIECE CHILDS GARMENT

(71) Applicants: Larry C Green, Jr., Annandale, VA (US); Marshall W Brooks, III, New Hyde Park, NY (US)

(72) Inventors: Larry C Green, Jr., Annandale, VA (US); Marshall W Brooks, III, New Hyde Park, NY (US)

( * ) Notice: Subject to any disclaimer, the term of this patent is extended or adjusted under 35 U.S.C. 154(b) by 181 days.

(21) Appl. No.: 13/723,196

(22) Filed: Dec. 20, 2012

(51) Int. Cl.
*A41D 11/00* (2006.01)
*A41D 15/00* (2006.01)

(52) U.S. Cl.
CPC ..... *A41D 11/00* (2013.01); *A41D 15/00* (2013.01)

(58) Field of Classification Search
CPC ..... A41D 1/00; A41D 11/00; A41D 13/00; A41D 13/02; A41D 13/0587; A41D 13/1272; A41D 19/0044; A41D 19/0048; A41D 15/002; A41B 7/00; A41B 7/02; A41B 9/004; A41B 9/005; A41B 9/007; A41B 9/008; A41F 11/12
USPC ..... 2/80, 83, 69, 79, 269, 59, 125, 126
See application file for complete search history.

(56) References Cited

U.S. PATENT DOCUMENTS

| | | | | | |
|---|---|---|---|---|---|
| 904,383 | A | * | 11/1908 | Velasko | 2/83 |
| 1,066,703 | A | * | 7/1913 | Boyce | 30/71 |
| 1,255,491 | A | * | 2/1918 | Verde | 2/80 |
| 1,341,317 | A | * | 5/1920 | Hanna | 2/83 |
| 2,106,646 | A | * | 1/1938 | Murphey | 2/83 |
| 2,122,873 | A | | 7/1938 | Shuster | |
| 2,675,554 | A | | 4/1954 | Gertz | |
| 2,677,131 | A | | 5/1954 | Shuster | |
| 2,774,075 | A | | 12/1956 | Saccoccio | |
| 3,002,193 | A | | 10/1961 | Briskman | |
| 3,130,416 | A | * | 4/1964 | Mitchell et al. | 2/79 |
| 3,965,487 | A | | 6/1976 | Mazur | |
| 4,006,495 | A | | 2/1977 | Jones | |
| 4,068,316 | A | * | 1/1978 | Haywood | 2/126 |
| 4,122,553 | A | | 10/1978 | Pitkanen | |
| 4,554,682 | A | | 11/1985 | Hillquist | |
| 4,561,126 | A | | 12/1985 | Truman | |
| 4,697,288 | A | * | 10/1987 | Palumbo | 2/269 |
| 4,766,613 | A | * | 8/1988 | Wells | 2/227 |
| 4,999,850 | A | | 3/1991 | Grilliot et al. | |
| 5,023,953 | A | | 6/1991 | Bettcher | |
| 5,131,096 | A | | 7/1992 | Olson | |
| 5,404,592 | A | * | 4/1995 | Jackson | 2/125 |
| 5,533,209 | A | * | 7/1996 | Davis | 2/60 |
| 5,628,064 | A | * | 5/1997 | Chung | 2/70 |
| 5,708,977 | A | * | 1/1998 | Morkunas | 2/80 |
| 5,717,999 | A | | 2/1998 | Lurry | |
| 5,774,892 | A | | 7/1998 | Tisdale et al. | |
| 6,158,056 | A | * | 12/2000 | Riley | 2/269 |
| 6,247,178 | B1 | | 6/2001 | Bilda | |
| 6,298,485 | B1 | | 10/2001 | Heller | |

(Continued)

*Primary Examiner* — Gloria Hale
(74) *Attorney, Agent, or Firm* — Tangent Law Group, PLLC; Eric J. Weierstall, esq.

(57) ABSTRACT

A one-piece children's garment that fastens in the pelvic region configured such that the long sleeves detach from the short sleeves. The invention relates to an improvement to the one-piece children's garment whereby the long sleeves are removably attached to the short sleeves with one or more fasteners. The fastener can be colored according to the color of the garment. The short sleeves contain extra material to achieve a unique fold over, allowing the user the comfort and convenience of a short sleeved garment at will. Once the long sleeves are removed from the short sleeves, a folding process is completed by the user which discretely covers exposed snap fasteners to avoid further chaffing on an infant's skin.

20 Claims, 16 Drawing Sheets

(56) References Cited

U.S. PATENT DOCUMENTS

| | | | | |
|---|---|---|---|---|
| 6,349,412 | B1 * | 2/2002 | Dean | 2/102 |
| 6,349,413 | B1 | 2/2002 | Rose et al. | |
| 6,360,372 | B2 * | 3/2002 | Oster | 2/126 |
| 6,473,904 | B2 * | 11/2002 | Long | 2/2.15 |
| 6,654,968 | B2 * | 12/2003 | Braun et al. | 2/269 |
| 6,698,025 | B1 | 3/2004 | Hughes | |
| 7,305,717 | B1 * | 12/2007 | Brown | 2/114 |
| 7,650,650 | B2 | 1/2010 | Voege | |
| 7,971,272 | B2 | 7/2011 | Bailey et al. | |
| 2001/0052143 | A1 * | 12/2001 | Oster | 2/126 |
| 2009/0235434 | A1 * | 9/2009 | Ratcliffe | 2/269 |
| 2009/0293171 | A1 * | 12/2009 | Fayle et al. | 2/85 |
| 2010/0125930 | A1 | 5/2010 | Burrell, IV | |
| 2010/0212069 | A1 * | 8/2010 | Williams et al. | 2/244 |
| 2010/0299798 | A1 * | 12/2010 | Fayle et al. | 2/69 |

* cited by examiner

LONG SLEEVE TO SHORT SLEEVE ON PIECE CHILDS GARMENT

BACKGROUND OF THE INVENTION

The present invention relates to children's garments, and more specifically to one-piece children's garments that are fastened with snaps in the pelvic region. The classic baby one-piece garment can be purchased separately; as a long sleeved or short-sleeved garment. For a number of years, the one-piece children's garment has remained one of the most significant garments worn by children on a daily basis.

The present invention is an improvement to the classic children's one-piece garment configured such that material covers the arms, and the upper and lower torso, with crotch entry. The invention includes but is not limited to children's garments that require fasteners in the pelvic region such as, sleepers, rompers, body suits, and similar garments and may or may not contain any leg portions or leg portion attachments. The invention contains long sleeves that detach from the short sleeves, and a simple folding process using extra material in the short sleeves to keep the fasteners covered, and to provide a softer, non-abrasive transition. The improvement will alleviate the worries about determining whether or not the child will need to wear long or short sleeves due to varying outdoor and indoor temperatures, feeding, playing, etc. Also, importantly the conversion can be done "on the fly", that is without having to remove the infant or baby from the garment. In addition, it will be more cost effective for the consumer to purchase the one-piece children's garment that contains both long and short sleeves.

DESCRIPTION OF PRIOR ART

Several attempts at convertible clothing or detachable garment pieces have been made in a number of references. There are also some references to adjustable garments, even adjustable child garments. Some of these include:

Table of Patents:

| Pat. No. | Issue/Pub Date | Inventor |
|---|---|---|
| 2,122,873 | Jul. 5, 1938 | SHUSTER |
| 2,675,554 | Apr. 20, 1954 | GERTZ |
| 2,677,131 | May 4, 1954 | SHUSTER |
| 2,774,075 | Dec. 18, 1956 | SACCOCCIO |
| 30002193 | Oct. 3, 1961 | BRISKMAN |
| 3,965,487 | Jun. 29, 1976 | MAZUR |
| 4,006,495 | Feb. 8, 1977 | JONES |
| 4,122,553 | Oct. 31, 1978 | FITKANEN |
| 4,554,682 | Nov. 26, 1985 | HILLQUIST |
| 4,561,126 | Dec. 31, 1985 | TRUMAN |
| 4,999,850 | Mar. 19, 1991 | GRILLIOT |
| 5,023,953 | Jun. 18, 1991 | BETTCHER |
| 5,131,096 | Jul. 21, 1992 | OLSON |
| 5,404,592 | Apr. 11, 1995 | JACKSON |
| 5,533,209 | Jul. 9, 1996 | DAVIS |
| 5,717,999 | Feb. 17, 1998 | LURRY |
| 5,774,892 | Jul. 7, 1998 | TISDALE. |
| 6,247,178 | Jun. 19, 2001 | BILDA |
| 6,298,485 | Oct. 9, 2001 | HELLER |
| 6,349,413 | Feb. 26, 2002 | ROSE |
| 6,360,372 | Mar. 26, 2002 | OSTER |
| 6,698,025 | Mar. 2, 2004 | HUGHES |
| 7,650,650 | Jan. 26, 2010 | VOEGE |
| 7,971,272 | Jul. 5, 2011 | BAILET |
| 20090293171 | Dec. 3, 2009 | FAYLE |
| 20100125930 | May 27, 2010 | BURRELL |

While there have been numerous references that focus on convertible clothing as a means to provide the wearer with convenience, accessibility, adjustability, and high-fashion, none of the relevant prior references specifically focuses on the one-piece children's garment that contains either long or short sleeves, is fastened in the pelvic region and features long sleeves that detach from the short sleeves, with a folding process to provide comfort and visual appeal.

For instance, there are a number of convertible shirt/pants combinations, as evidenced by U.S. Pat. No. 6,349,413 B1, U.S. Pat. No. 7,650,650 and U.S. Pat. No. 5,774,892, with gathered or removable appendage portions. However, these fail to address the challenges found in the one-piece child's garment that fastens in the pelvic region. In particular, the nature and complexity of the removal and the need to remove the wearer from the garment has proven to be hurdles in creating an effective convertible infant or baby or children's garment to accommodate both long-sleeved and short-sleeved configurations.

Additionally, there are special considerations in providing a baby garment, particularly the comfort of the infant and the prevention of chaffing or other discomfort from components that would act as attachment points but may also upset infant skin, these issues not being addressed in the designs of adult clothing. In addition, these prior solutions have focused on adjusting for growth/length in the wearer, for specialized career/hobby applications, increased durability shirt/pant combinations, or they were constructed such that multiple uses for the garment are accomplished through several steps and components overcomplicating the garment.

As such, the present invention specifically focuses on the common challenges and endeavors parents and caretakers encounter throughout the child's daily routine. It provides a long-sleeve to short-sleeve garment that does not require removal of the garment to selectively change from long to short sleeves. Due to the simple folding process, the invention is cost effective, easy to use, and extremely convenient. Similarly, it provides the level of comfort needed to accommodate children and protect against chaffing delicate infant skin, as well as providing a consistent and clean look. The instant invention provides such a garment.

SUMMARY OF THE INVENTION

In view of the foregoing, the present invention is an improvement to the one-piece children's garment that covers the upper and lower torso, and is fastened with snaps in the pelvic region. The upper portion of the invention comprises of long sleeves that are detachable from the short sleeves, and may be manufactured in a variety of fabrics, colors, designs, etc. The invention can also provide a fabric fold over portion of the short sleeve to be folded over to cover connectors or similar safeguards to protect the infant from chaffing against the connector components.

The object of the invention is to provide convenience to the classic one-piece children's garment and reduce costs to the consumer by reducing the number of garments needed.

Another object of the invention is to resolve the issues parents typically face when deciding if the child needs a long sleeved or short sleeved garment on any given day. It is yet another object of the invention to create a cost effective garment which will allow consumers to purchase one single garment consisting of both long and short sleeves.

A still further object is to provide a convertible long sleeve to short sleeve infant garment with further protection against chaffing of the skin of an infant or other discomfort from the exposure of attachment points of the long sleeves to the short sleeves. Several other objects and features unique to the present invention may be seen in the descriptions, preferred embodiments, and appended claims.

The apparatus of the invention includes a baby garment with crotch entry having a torso section with a crotch entry section and a first sleeve section with an at least one first sleeve section attachment device forming a lower, long sleeve detachable portion on the garment. A second sleeve section forms an upper, short sleeve on the garment with an at least one second sleeve section fastener device that selectively couples with the at least one first sleeve section fastener device on the lower, long sleeve section. A fold section extends from a distal end of the second sleeve section beyond the at least one fastener device on the lower, long sleeve section, wherein in a first configuration the first, long sleeve detachable portion is coupled to the second, short sleeve portion by the mating of the respective at least one fastener devices on each sleeve portion and in a second configuration, the first, long sleeve detachable portions is detached and the corresponding fasteners detached from the second, short sleeve section and the fold section is folded so that the fold section covers the at least one fastener device on the second short sleeve section.

The at least one fastener on the first sleeve section is on an inside of the first sleeve section and the at least one fastener on the second sleeve section can be on an outside of the second sleeve section. A further foldable section can extend from the first, long sleeve section and can extend under the at least one fastener on the second sleeve section when the sleeves are joined such that the fasteners on the second, short sleeve section are between the foldable section and the at least one fastener on the first sleeve section when the at least one fastener on the first sleeve section and the at least one fastener on the second sleeve section are engaged in the first configuration.

The at least one fastener on the first sleeve section can also be on an outside of the first sleeve section and the at least one fastener on the second sleeve section is on an inside of the second sleeve section. The fold section can include an at least one stich line defining the fold section and providing for folding on the line. The at least one fastener on the second sleeve section can include a first row of fasteners located on a portion of the second sleeve section above the fold section and a second row of fasteners located on the second sleeve section on the fold section and engaging the at least one fastener on the first long sleeve section in the first configuration, and when the fold section is folded onto the second sleeve section in the second configuration, the first row of at least one fastener on the second sleeve mates with the second row of at least one fasteners on the second sleeve portion and retains the fold section in a folded state. The at least one fastener on the first sleeve section can be an at least one snap fastener and the at least one fastener on the second sleeve section is an at least one snap fastener, wherein the respective at least one fasteners are corresponding mating fastener sections. The at least one fastener on the first sleeve portion can also be an at least one hook and loop fastener and the at least one fastener on the second sleeve portion is an at least one hook and loop fastener, wherein the respective at least one fasteners are corresponding mating fastener sections.

The fold section can be folded such that the fold section in the second configuration is atop an outer portion of the second sleeve section. A further fold or cover section can be provided, wherein the fold section is covered by the further fold or cover section. An at least one further second sleeve section fastener device can also be provided, wherein after folding the fold section the at least one second sleeve section fastener device on the fold section is coupled to the at least one further second sleeve section fastener device. The fold section can additionally include a further extended fold section and the further extended fold section folds over the fold section and both the further extended fold section and the fold section are folded over the outer portion of the second sleeve section.

The fold section can be folded such that the fold section is folded inside the upper, second sleeve section, atop an inner portion of the second sleeve section. A further fold or cover section, wherein the fold section is covered by the further fold or cover section upon folding into the second sleeve section. A third set of fasteners can be provided, wherein after folding the fold section the fold section is coupled to the third set of fasteners. The fold section can include a further extended fold section and the further extended fold section folds over the fold section and both the further extended fold section and the fold section are folded under the inner portion of the second sleeve section.

A further fold section and a cover section can also be provided, wherein in the second configuration the fold section is folded into the cover section and the further fold section extends beyond an end of the fold section and the further fold section is folded over and onto the outside portion of second sleeve section. A further fold section and a cover section can also be provided, where in the second configuration the cover section folds down over the fold section and covers the fold section and the further fold section extends beyond an end of the fold section and the further fold section is folded over and onto an inside portion of second sleeve section.

Yet a further fold and a cover section with an extended additional fold section, wherein in the second configuration the cover section with the extended additional fold section extends beyond the cover section and folds over the end of the fold section and under and into the second sleeve portion. The fold section can extend over the at least one second sleeve section fastener device and a cover section that extends from within an inside section of the second, short sleeve section under an at least one second sleeve section fastener device, such that in said first configuration the at least one first sleeve section fastener device and at least one second sleeve section fastener device are coupled between the fold section and the cover section and in said second configuration the at least one second sleeve section fastener device is covered by the fold section and the cover section.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

DETAILED DESCRIPTION OF THE DRAWINGS

Before explaining at least one embodiment of the invention in detail, it is to be understood that the invention is not limited in its application to the details of construction and the components set forth in the following description of an exemplary embodiment. Moreover, the exemplary embodiments shown are only non-limiting examples of the instant invention.

Figure 1:
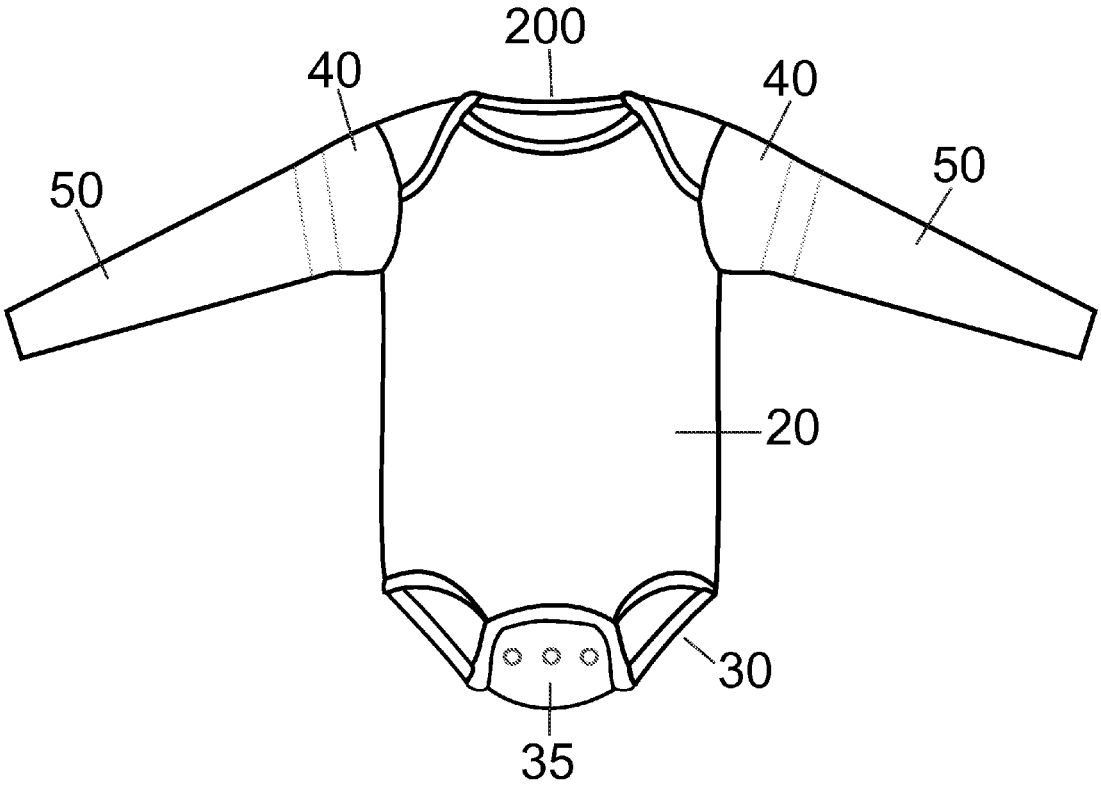
FIG. 1 shows a front view of a "one-piece" child's garment incorporating a single torso section and designed in accordance with the principles of the present invention representing a first exemplary embodiment thereof.

FIG. 1 shows a front view of a one piece child's garment designed in accordance with the principles of the present invention. As seen in FIG. 1, the exemplary embodiment shown comprises a torso section 20 having a crotch section entry 30 with an at least one fastener 35, in this instance several snap fasteners, coupled to the crotch portion on a front of the crotch portion and on a back flap of the crotch portion. The infant enters the garment through the open crotch section 35, typical of this type of garment typically known as a "onesie." This garment is shown as an exemplary embodiment and is non-limiting in describing a suitable infant garment with the positively claimed limitations. Other examples and variations can include but are certainly not limited to a legged "onesie", and those discussed and described herein. Further non-limiting examples of exemplary embodiments are included as FIGS. 5-9 as descried herein below.

Figure 2A:
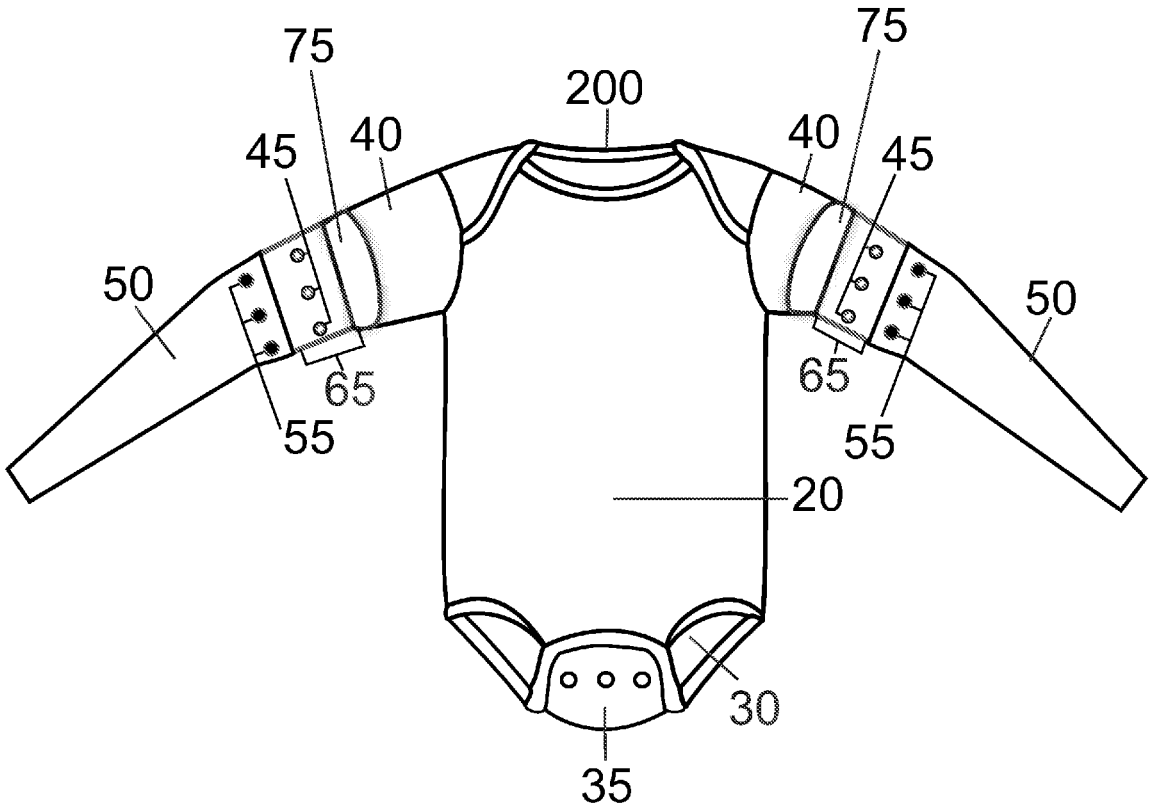
FIGS. 2A and 2B are front views of a one-piece child's garment in an intermediate state wherein the connected long and short sleeves are exposed and preparations made for detachment of the sleeves.
Figure 2B:
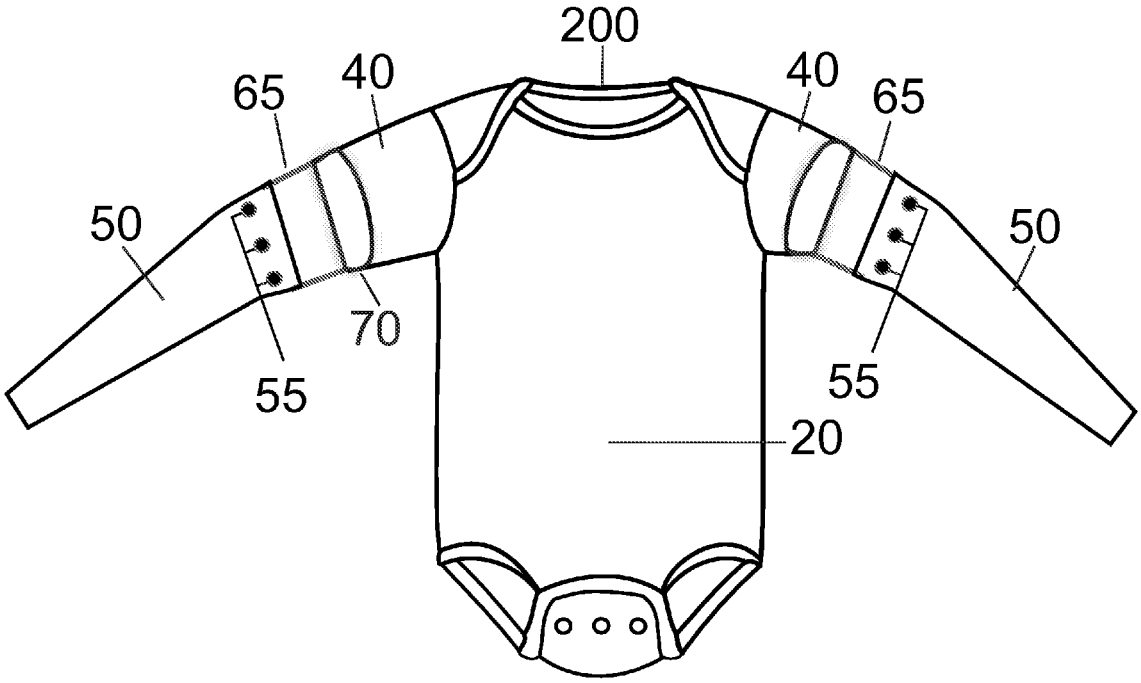

Extending from the torso portion 20 are appendages or sleeves. The sleeves have two sections. A first, lower or long sleeve section 50 is removably attached to a second, upper or short sleeve section 40. A neck portion or hole 200 allows for the head to protrude. The first sleeve section 50 and second sleeve section 40 are removably attached by coupling an at least one fastener device 55 to a matching, mating at least one fastener device 45 as seen in FIGS. 2A and 2B. The respective at least one fastener devices 45, 55 are shown in the non-limiting exemplary embodiment as a set of snaps. Further non-limiting examples of attachment devices include but are not limited to hook and loop fasteners, eye and hook, buttons, VELCRO, various magnet fasteners, garment tapes, various snap fasteners, garment adhesives, ties, and the like that may be used in any of the embodiments disclosed herein. On the first, lower, long sleeve section 50, and at least one fastener device is provided. On the second, upper, short sleeve section a matching, mating at least one fastener device 45 is provided, as better seen in FIGS. 2-3C. For sake of brevity and clarity, reference will be made to male and female snap members, however, as previously noted these are non-limiting examples of fastening devices that could be utilized with the instant invention.

In the exemplary embodiment shown in FIGS. 1-2B, extending from the distal end of the second, upper, short sleeve section 40 is a fold section or portion 65. The fold section can be distinguished as being the portion extending beyond the at least one fastener device 45. It can also have an additional stitching element or fold line 70 to facilitate easy folding over of the fold section 65. Optionally, as shown and noted in the various embodiments contained herewith, a further flap or cover foldable section 75 can be provided to cover the at least one fastener. As seen in the accompanying figures, in the exemplary embodiments the fastener devices 45, 55 are detached and the first, lower, long sleeve portion or section 50 is removed from the second, upper, short sleeve portion or section 40 to convert the garment to a short sleeve garment, the fold section 65 and in a folding operation the other optional components are then folded over or tucked over the remaining exposed at least one fastener device 45 to prevent scratching or abrasion on the infant. In a first step in the conversion of the exemplary embodiment of FIG. 1 the flap or cover foldable section 75 is folded over toward the body section to expose the at least one fastener 45,55, as seen in FIG. 2B. In additional embodiments detailed herein, the conversion may omit the cover or foldable section 75 and/or fold under toward the body section 20, for instance the embodiment shown in FIG. 2A, or function with additional material and components to aid in concealing the fasteners and protecting the child from chaffing while providing for the effective conversion of the garment, as seen in further embodiments of FIGS. 5A-9B.

FIG. 2A is a front view of the one piece child's garment of FIG. 1 with fold section prepared and detached from the short sleeves. As seen in FIG. 2A, the two sections of the sleeve 40, 50 are detached. The first, lower, long sleeve section 50 having been prepared to be removed. The at least one fastener device or attachment device 55, which in the exemplary embodiment shown is inside the first, lower, long sleeve section 50. The upper, short sleeve section 40 is attached with the at least one fastener device 45. Again, reference is made herein to snap fasteners as non-limiting examples to clearly convey the elements and methods of the invention. The respective at least one fasteners 45, 55 on the respective sleeve portions 40, 50 are snapped together in the exemplary embodiment and can be colored according to the color of the garment to more effectively camouflage their existence.

Figure 3A:
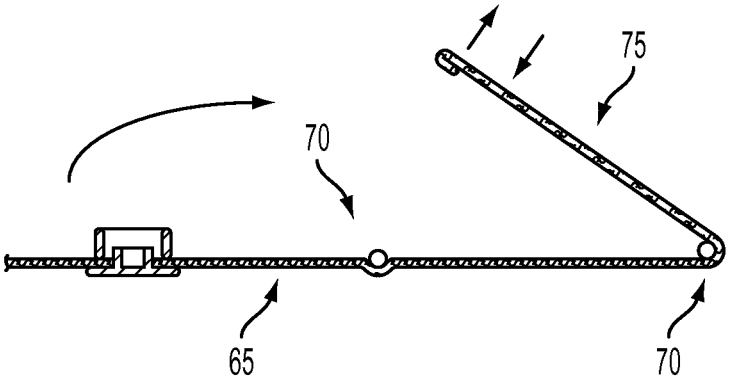
FIGS. 3A-3C show several sectional views of various mechanisms and methods for folding and concealing the at least one fastening device in FIGS. 1-2B several exemplary embodiments of the child's garments of FIGS. 1-2B.

The fold section 65, an integral section of the upper, short sleeve portion folds in one of several different processes to complete the conversion of the garment into a short sleeve garment while providing for protection against chaffing from the fasteners 45, 55. The fold section 65 in the embodiment shown can be distinguished as being the portion extending beyond the at least one fastener device 45. The fold section 65 folds over the exposed at least one fastener device 45 in some embodiments to prevent scratching or abrasion on the infant by the exposed fastener in a folding operation as shown by the arrow. In some instances, the fold section 65 is tucked under the upper sleeve portion 40 as seen in FIGS. 3C and 7B. In still further instances, optional elements are folded over or moved to cover the fold section 65, as seen in FIGS. 3C (in shadow), 6B and 7B. The fold section 65 can also have an additional stitching element or line 70 to facilitate easy folding over of the fold section 65, as seen in several of the figures. In all instances, the exposure of the at least one fastener 45 to the infants skin is minimized while a desirable finished look is provided for the converted short sleeve garment.

In the exemplary embodiment shown, as noted above, the at least one fastener devices 45, 55 are snaps having a male and female portions. By coupling the at least one fastener device 55 to a matching, mating at least one fastener device 45, e.g. male 55 to female 45, the sleeve sections 40,50 are coupled. This of course can be varied without departing from the invention. By uncoupling the mated fastener devices, the sleeve sections 40, 50 are detached. In the exemplary embodiment shown, the cover flap section 75 is first moved upward, folding toward the torso section 20 and the first or lower sleeve portion 50 is detached from the second or upper sleeve portion after 40 to convert the garment to a short sleeve garment. The now exposed at least one fastener device 45 is a female device on the upper, short sleeve portion 40. The exposed at least one fastener device 45 is then covered by either returning the cover flap section 75 over the fold section 65 or by folding the fold section 65 containing the at least one fastener device 45 up and over toward the torso and then covering same with the cover flap section effectively tucking the fold section 65 under the cover section 75, as best seen in FIG. 3A herein. In this case, the embodiment of FIG. 2A utilizes the cover section 75, which is folded up and the fold section 65 folded up and then tucked under the cover section 75 as shown in FIG. 3A. By comparison, FIG. 2B shows an exemplary embodiment that does not use cover section 75 and operates in a fashion shown in FIG. 3B.

Thus, when the sleeve sections are attached the garment is long sleeved and the fasteners are separated from and protect the skin of the infant from contact via the material of the sleeve sections 40, 50. When detached, as shown in FIGS. 2-3C, the at least one fastener which would otherwise remain exposed and, which could for instance, chafe or contact an infant's face, is engaged by the fold section 65 alone or in conjunction with other components to avoid such possible insult to the skin of the infant, as noted above. The final disposition of the garment is shown in various configurations herein contained in FIGS. 3-9B.

FIG. 2B is a front view of the one piece child's garment of FIG. 1 with fold section prepared to detach from the short sleeves. The embodiment of FIG. 2B is nearly identical to FIG. 2A, omitting the cover flap section 75 and including a first and second layer of material sewn as a cuff in the fold section 65. As seen, FIG. 2B shows the fold section 65 after the fold operation has moved the fold section 65 toward the torso section 20 up on upper sleeve section 40. This embodiment is similar to and the fold operation for this embodiment is similar but opposite to that shown in FIG. 3C.

FIG. 3A shows a cross section of the upper half of the juncture of the upper and lower sleeve portions of the exemplary embodiment of a garment of FIG. 2A. The fold section being folded and then hiding the snaps underneath the folded material. As seen, in the exemplary embodiment shown, the cover fold section 75 is folded away from the sleeve section and the fold section 65 is folded up as shown by the arrows. The cover fold section 75 is then returned to cover and conceal the fold section 65 and the at least one fastener device 45 contained thereon. This helps protect the infant from chafing or upset from contacting the exposed fastener.

Figure 3B:
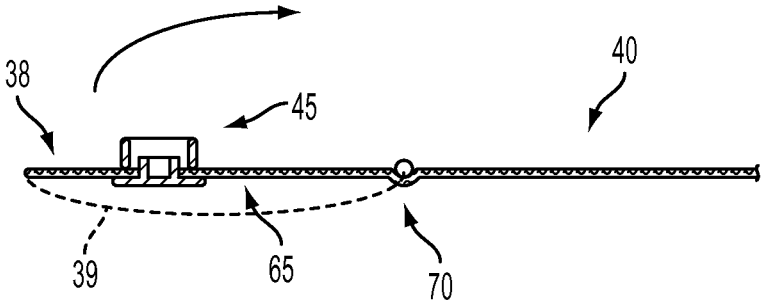
Figure 3C:
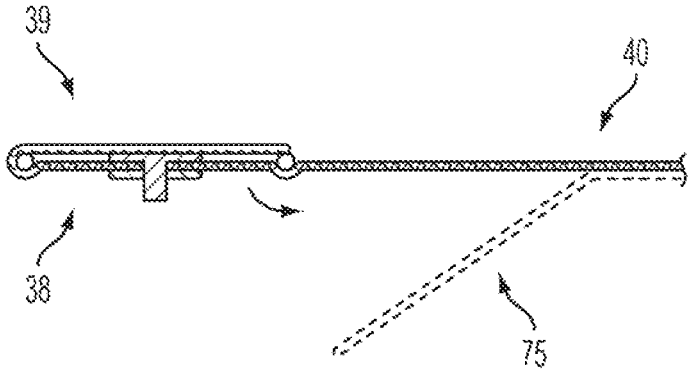

FIG. 3B shows a further cross section of the upper half of the juncture of the upper and lower sleeve portions of the exemplary embodiment of a garment of FIG. 2B. The fold section being folded up to the exterior of the garment without a cover portion. In the embodiment shown, the fold section 65 is provided as a double walled cuff, having the at least one fastening device 45, here a row of female snaps, sandwiched between a first layer of material 38 through which the row of female snaps 45 protrude and a second layer of material 39 that exists under the snaps 45 as shown. When the fold section 65 is folded toward the torso portion 20 as shown by the arrow, the resulting cuff covers the portion of the upper sleeve portion 40 with the first portion of material 38 having the row of previously exposed female snaps 45 protruding there through and exposes the second layer 39 of material. This again helps protect the infant from chafing or upset from contacting the exposed fastener. An alternative embodiment omits the double layer cuff, with the fasteners 45 being atop the corresponding fasteners 55 (not shown) on the lower, long-sleeve portion. In this alternate embodiment, the folding is done in a similar fashion and the uncovered fasteners 45 are folded up as shown. The fasteners in this alternative embodiment can be processed such that the exposed portion of the fastener is smoothed so as not to chafe the skin of the infant.

FIG. 3C shows a further cross section of an exemplary embodiment of a child's garment, with the fold section being folded and then hiding the snaps. In this instance, the fold section 65 is "tucked" or folded under the upper sleeve section 40. In embodiment the at least one fastening device 45, again a row of female snaps, is either covered by a cover member 75 (shown in shadow) extending from within the upper sleeve portion 40, creating essentially a pocket as shown in FIG. 3C, or is folded under a second time or has a cuff mounting the at least one fastener or attachment device 45 with a first layer 38 penetrated by the at least one fastener 45 and a second layer 39 which covers the at least one fastener 45 when folded. Another variation on this is a version having a fold section 65 with multiple folds, for example, having two folding lines that fold over the fasteners then fold over a further time to form an exterior cuff (not shown). Similarly, if the at least one fastening device 45 is coupled from the above or outside to the at least one fastening device 55 on the lower or long sleeve portion 50, a single fold of fold section 65 may accomplish a similar result. A similar embodiment is shown in FIG. 7B that provides for a further section to fold over and cuff to the interior of the upper arm portion 40. This again helps protect the infant from chafing or upset from contacting the exposed fastener.

Figure 4:
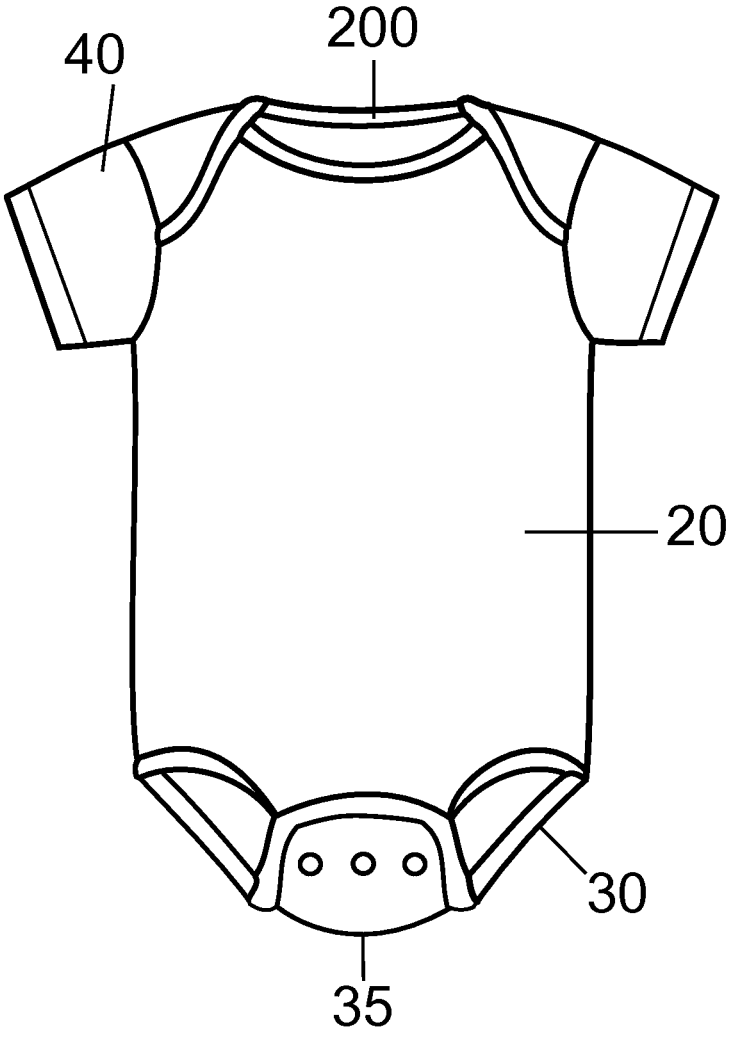
FIG. 4 shows the transformed garment with the long sleeves detached and the fold over process complete in an exemplary embodiment of a child's garment of FIGS. 1-3C.

FIG. 4 shows the transformed garment with the long sleeves detached and the fold over process complete in an exemplary embodiment of a child's garment of FIGS. 1-3C. After removal of the lower arm portions 50 from the upper arm portions 40, the baby garment 10 is effectively and efficiently converted from a long sleeve to a short sleeve garment. The completion of the folding process, on of any of the exemplary embodiments provided herein, results in the garment as shown being fully converted to a short sleeve garment.

Thus the conversion from a first configuration having a first, lower, long sleeve portion to a configuration having only a second, upper, short sleeve portion is completed and the exposed fasteners are covered and protected while maintaining a visually desirable look. The conversion from one configuration to the other is accomplished without having to remove the infant garment. The resulting garment is also cost effective for the parents and easily manufactured. In addition to the exemplary embodiment of FIGS. 1-3C, additional embodiments are shown in FIGS. 5-9.

Figure 5A:
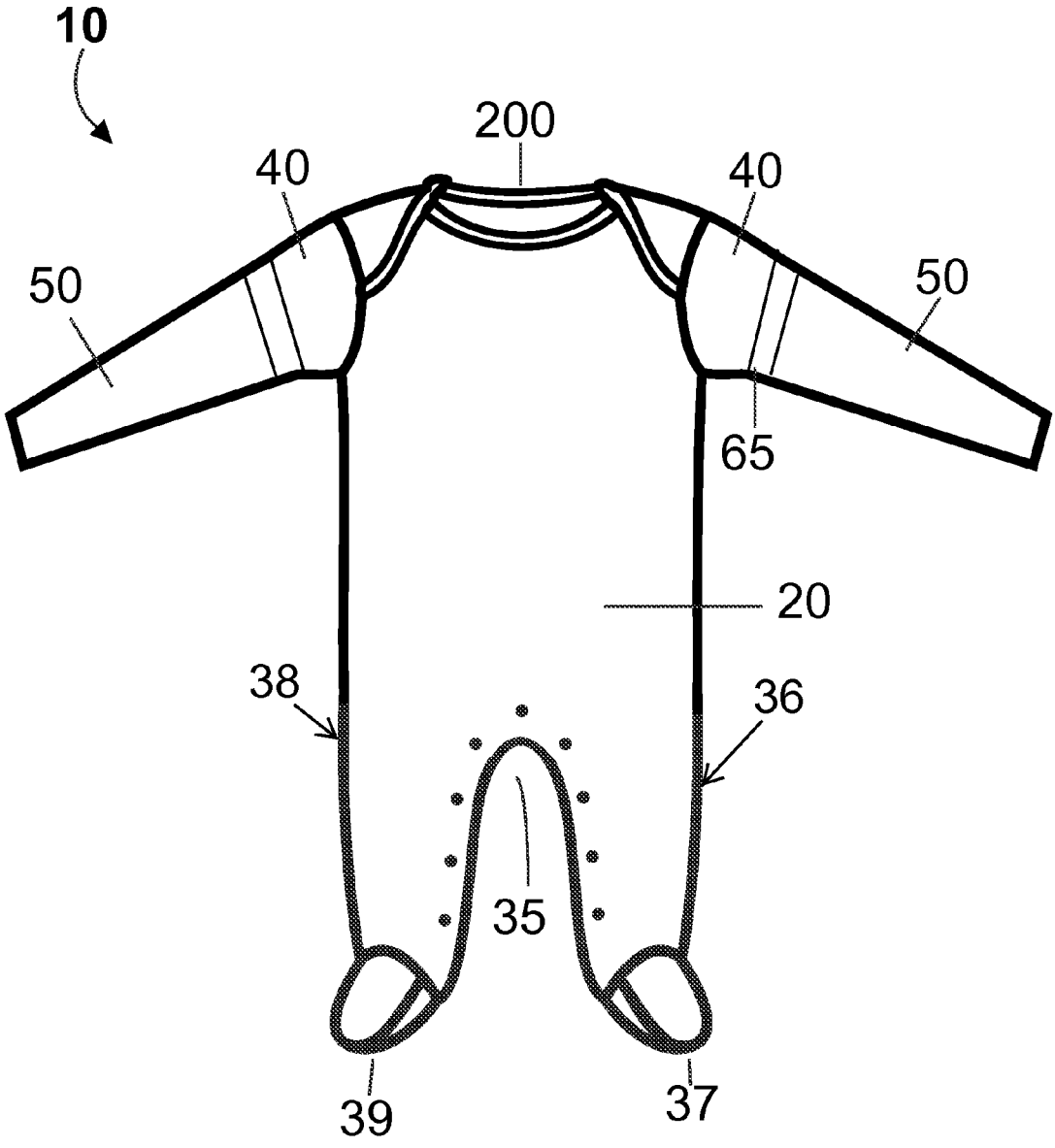
FIGS. 5A and 5B show a front view of a further exemplary embodiment of a children's garment and a cross sectional view of the connection of on intersection of the sleeve elements of the further exemplary embodiment of a child's garment of FIG. 5A.
Figure 5B:
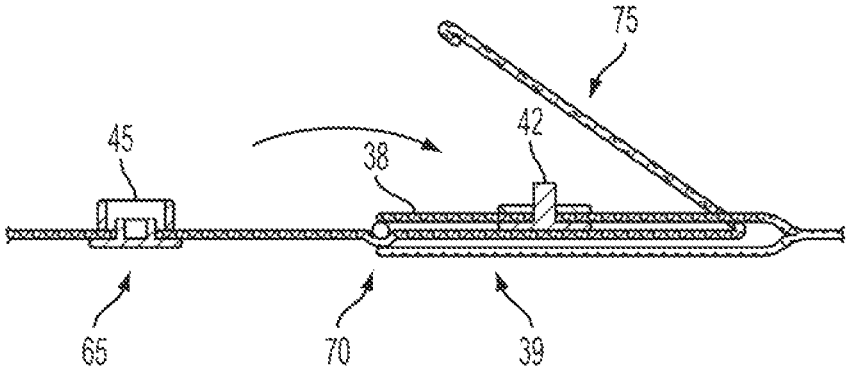

FIGS. 5A and 5B show a front view and a cross sectional view of the connection of sleeve elements of a further exemplary embodiment of a child's garment . . . . The child's garment 10 shown has a snap crotch entry 30 with legs 36, 38 that snap from the right foot 37 through the snap crotch section 35 to the left foot 39. FIG. 5B details a cross-section of the attachment of the first or lower sleeve portion 50 to the upper or short sleeve portion 40. As seen in FIG. 5B, the cover fold section 75 is folded up. The lower sleeve portion 50 is detached from the upper sleeve portion 40. The fold section 65 is then similarly folded up. In this embodiment, the fold section 65 is coupled to a further set of at least one sleeve fasteners 42 which mate with and hold the fold section 65 in place. The cover fold section 75 is lifted and then returned to cover and conceal the fold section 65 and the at least one fastener device 45 contained thereon. This helps protect the infant from chafing or upset from contacting the exposed fastener as does the placement of the further set of fasteners 42 in between two layers of material. The further set of fasteners penetrates the first material 38. Additionally, it is further understood that the various further embodiments disclosed herein can also include a further set of fastener devices 42 that mate with the at least one fastener device 45 and assist in keeping the folded portion 65 in place.

Figure 6A:
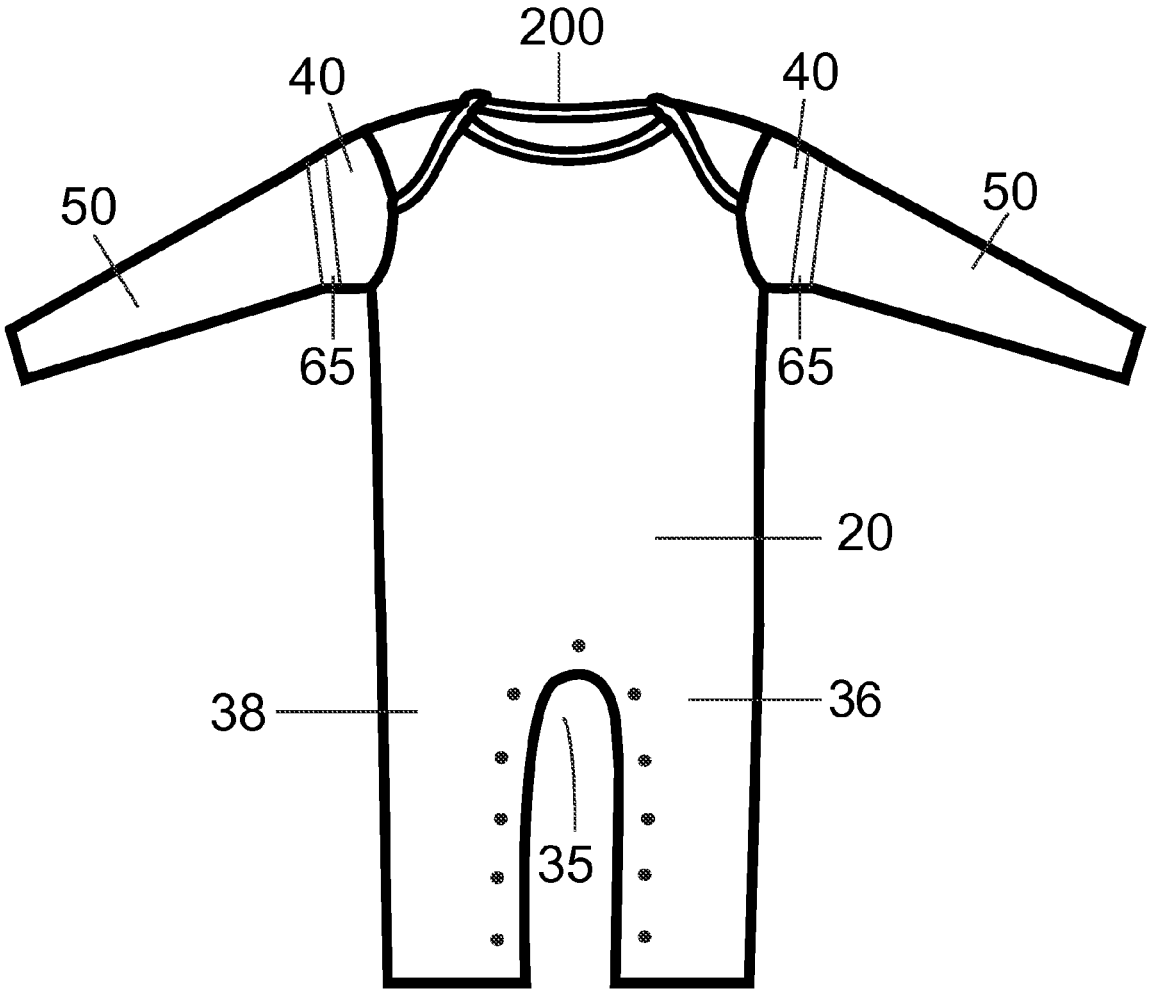
FIGS. 6A and 6B show a front view of a still further exemplary embodiment of a children's garment and a cross sectional view of the connection of on intersection of the sleeve elements of the still further exemplary embodiment of a child's garment of FIG. 6A.
Figure 6B:
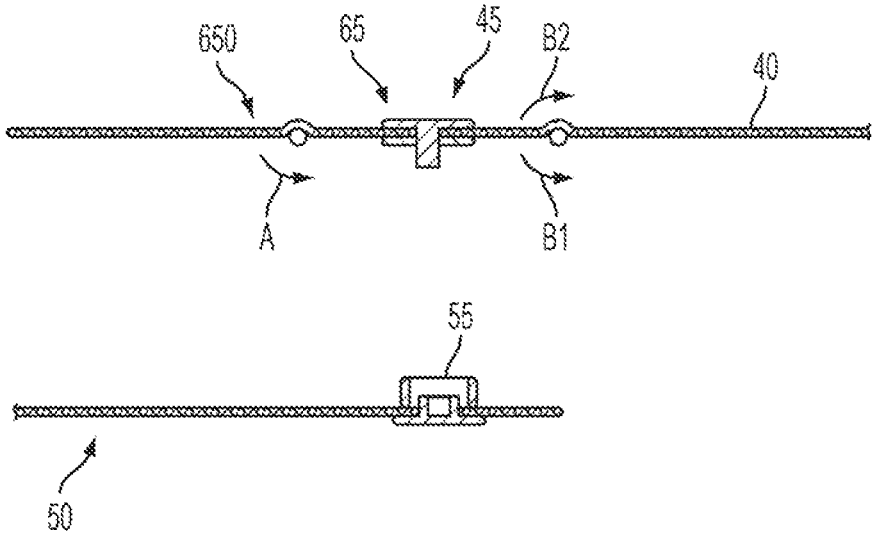

FIGS. 6A and 6B show a front view and a cross sectional view of the connection of sleeve elements of a still further exemplary embodiment of a child's garment. As seen in FIG. 6A, the child's garment 10 shown has a snap crotch entry 30 with legs 36, 38 that snap from the right leg 38 through the crotch area 35 to the left leg 36. Additionally, the snap and fold section feature is varied but similar to that shown in FIGS. 1-3C in that an extra-long fold flap section 650 is provided extending from the upper or short sleeve portion 40 and over the fold section 65, extending beyond the previously shown juncture of the short and long sleeve portions 40, 50, as best seen in FIG. 6B. The extra-long fold flap section 650 extending over to cover the at least one fastening members 45, 55 in a further folding operation "A" and allowing a further fold over or tuck under operation "B" of the extra-long fold flap section 650. In the embodiment shown, the extra-long fold flap section 650 extends from without the short sleeve section 40 and tucks under and into the short sleeve section, folding in the direction of the arrow shown at "B1" with the fold section 65. An alternative embodiment utilizes a second folding operation in the direction of the arrow shown as "B2" over the outside of sleeve section 40.

Figure 7A:
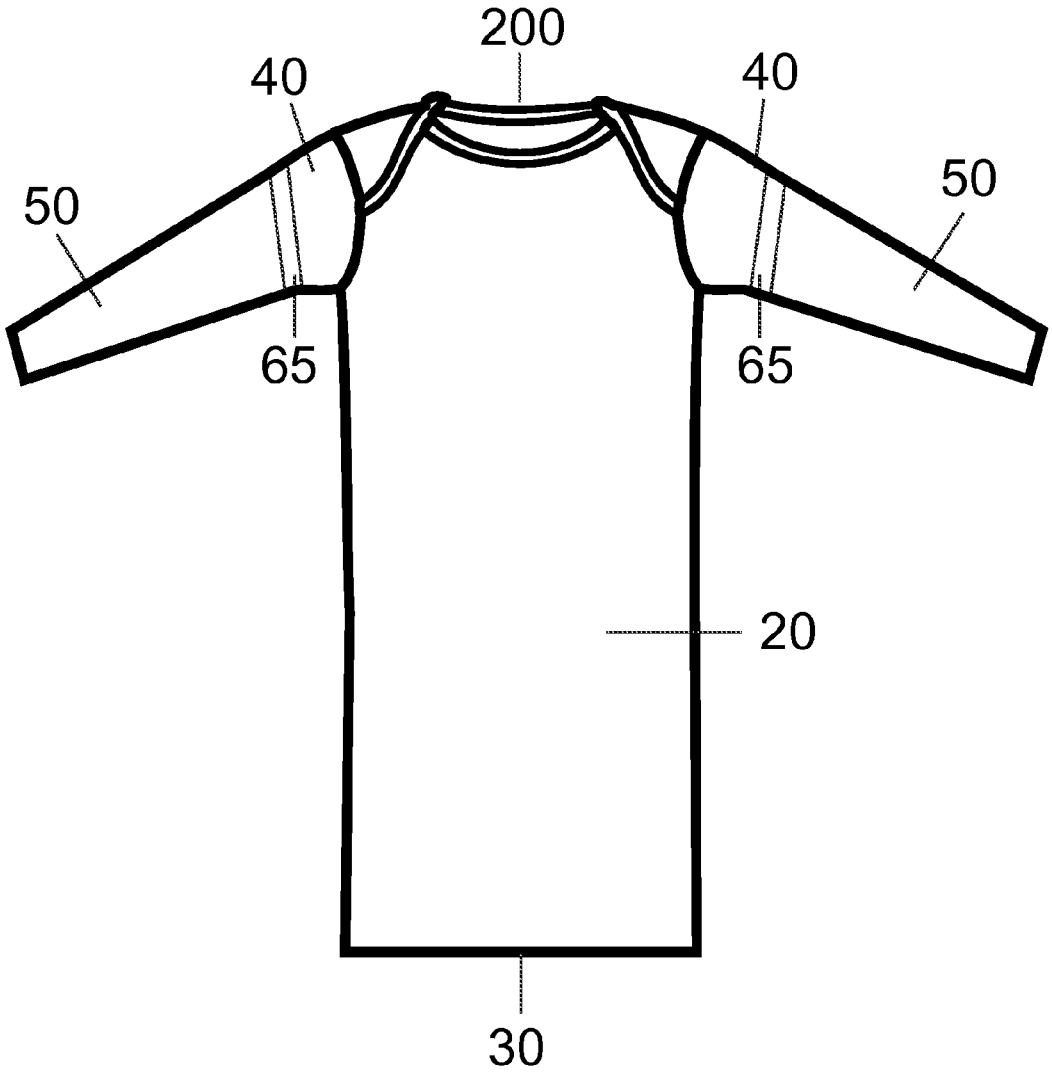
FIGS. 7A and 7B show a front view of a yet another exemplary embodiment of a children's garment and a cross sectional view of the connection of on intersection of the sleeve elements of the yet another exemplary embodiment of a child's garment of FIG. 7A.
Figure 7B:
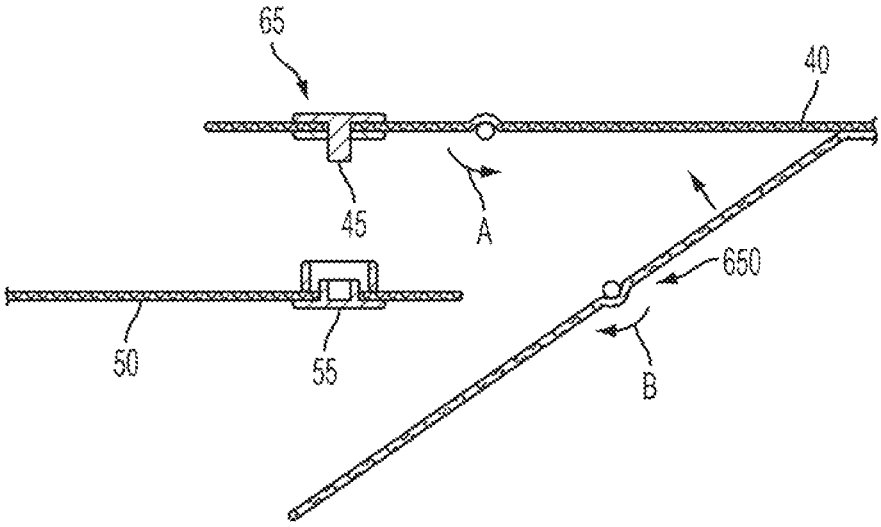

FIGS. 7A and 7B show a front view and a cross sectional view of the connection of sleeve elements of yet a further exemplary embodiment of a child's garment. The child's garment 10 shown has a crotch entry area 30 with no snaps in the crotch area as shown. Similar to FIG. 6B an extra-long fold flap 650 is provided. The extra-long fold flap 650 extends under the fold flap 65 and the juncture of the short and long sleeve sections 40, 50, beyond and below the row of fasteners 45 allowing the fold section 65 to be folded in folding action or operation "A" under and into the extra-long fold flap 650. Extra-long fold flap 650 is then folded in the direction of the arrow up to and over the row of fasteners 45 at and about a folding point, the folding action is shown at "B" and folds over and outside the short sleeve section 40 forming a finished cuff.

Figure 8A:
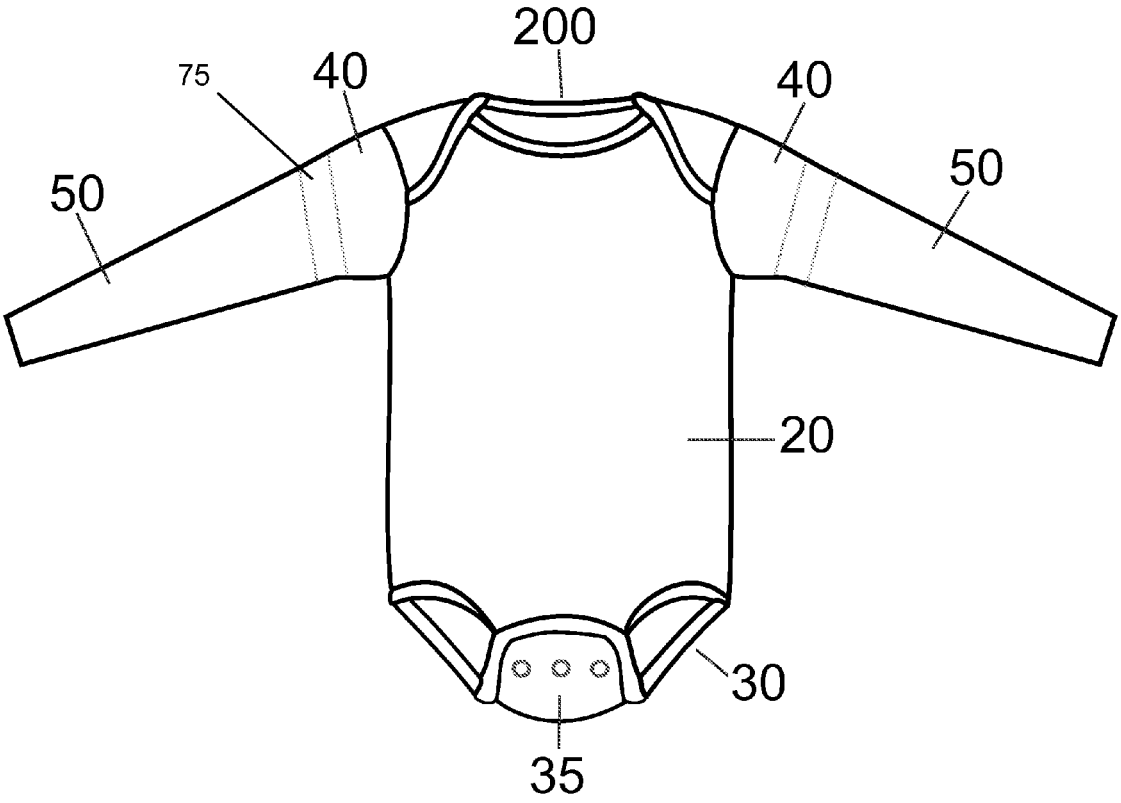
FIG. 8A shows a front view of another exemplary embodiment of a child's garment.
Figure 8B:
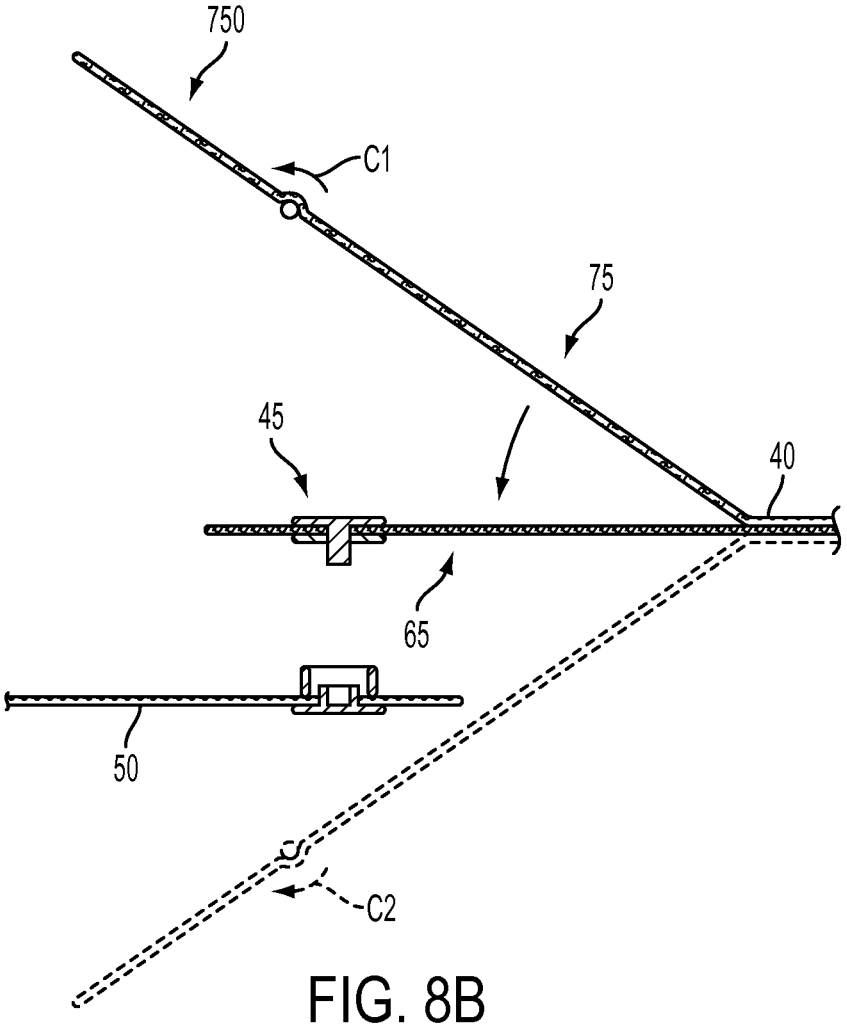
FIG. 8B shows a further cross sectional view of the sleeves of the embodiment of FIG. 8A.

FIGS. 8A and 8B show a further exemplary embodiment of the instant invention. In this embodiment, as seen in FIG. 8A, a torso portion 20 with a crotch entry area 30 having fasteners 35 is provided. Extending from the torso portion 20 are appendages or sleeves. The sleeves have two sections. A first, lower, long sleeve section 50 is removably attached to a second, upper, short sleeve section 40. The first sleeve section 50 and second sleeve section 40 are removably attached by coupling an at least one fastener device 55 to a matching, mating at least one fastener device 45. The respective at least one fastener devices 45, 55 are shown in the non-limiting exemplary embodiment as a set of snaps. On the first, lower, long sleeve section 50, an at least one fastener device is provided. On the second, upper, short sleeve section a matching, mating at least one fastener device 45 is provided. Over this is a cover section 75 is provided with a further foldable section 750 that extends beyond the juncture of the short and long sleeve sections 40, 50.

As seen in FIG. 8B, when the sleeve sections 40, 50 are detached, the further foldable section 750 is shown extending past the row of fasteners 45 in the upper, short sleeve section 50. When the lower, long sleeve section 50 is detached, the further foldable section 750 folds over and covers the row of fasteners 45 contained on fold section 65. In this instance the further foldable section 75 can be folded up into the short sleeve section 40 or "tucked under" to both mask the row of fasteners 45 and provide a layer of fabric to protect against contact with the skin. Or the fold section 65 may be "folded out". In a further embodiment, shown in 8B in shadow, the further foldable portion 750 is provided under the row of fasteners 45, 55 such that the further foldable portion 750 overlaps the row of fasteners 45,55 from within the sleeve portion. When sleeve sections 40, 50 are detached, the further foldable section 750 can be folded up and over the end of the sleeve section 40 to cover fastener 45 from within and without the sleeve portion 40.

Figure 9A:
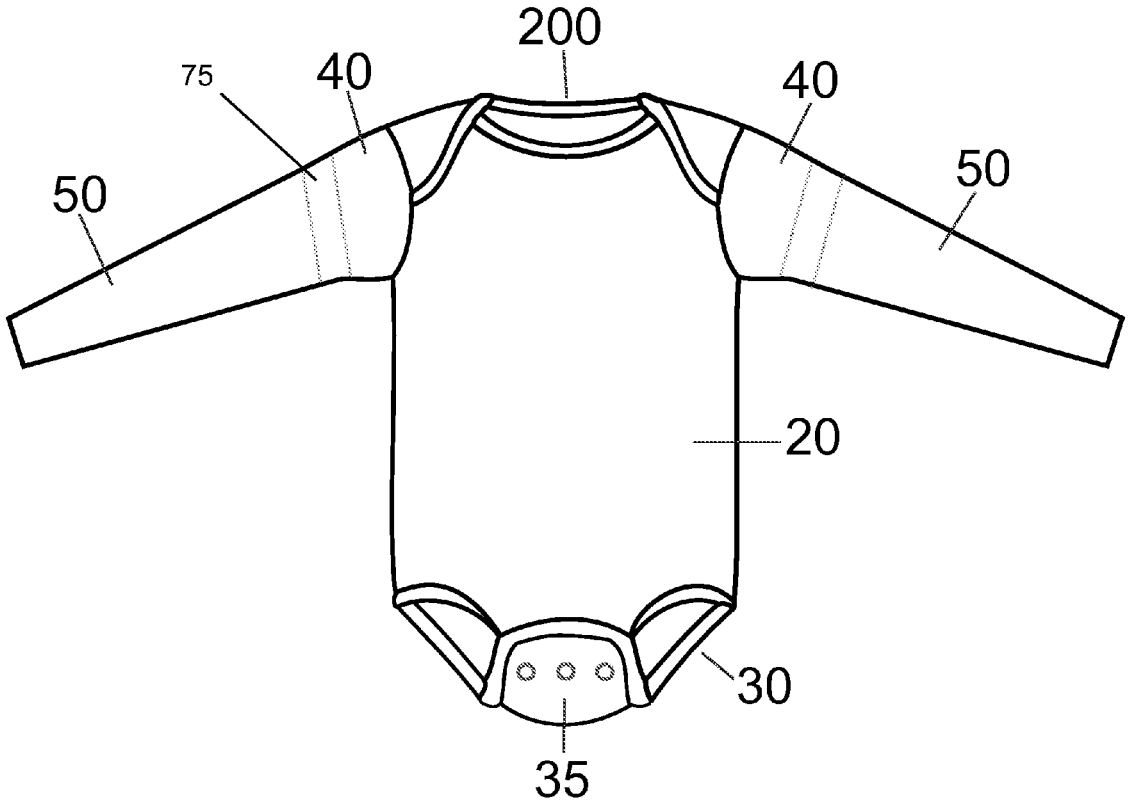
FIG. 9A shows a front view of yet another exemplary embodiment of a child's garment.
Figure 9B:
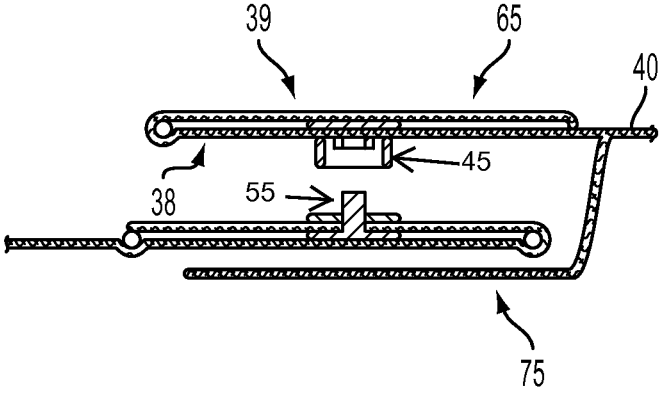
FIG. 9B shows a further cross sectional view of the sleeves of the embodiment of FIG. 9A.

FIGS. 9A and 9B show a further exemplary embodiment of the instant invention. In this embodiment, as seen in FIG. 9A, have a torso portion 20 with a crotch entry area 30 having a snaps section 35. Extending from the torso portion 20 are appendages or sleeves. The sleeves have two sections. A first, lower, long sleeve section 50 is removably attached to a second, upper, short sleeve section 40. The first sleeve section 50 and second sleeve section 40 are removably attached by coupling an at least one fastener device 55 to a matching, mating at least one fastener device 45. The respective at least one fastener devices 45, 55 are shown in the non-limiting exemplary embodiment as a set of snaps. A hole 200 is provided for the head and neck to protrude.

On the first, lower, long sleeve section 50, an at least one fastener device 55 is provided. On the second, upper, short sleeve section 40 a matching, mating at least one fastener device 45 is provided. Over this is a fold section 65 that extends at the juncture of the short and long sleeve sections 40,50 overtop the long sleeve section from the short sleeve section 40 in this instance providing a cuff over the exterior components of the fastener 45 with a first layer of cloth 39. A cover section 75 is shown in FIG. 9B extending under the row of fasteners 45, 55. These sections 65, 75 conceal the juncture of the sleeve sections 40, 50 and provide protection against chafing.

As seen in FIG. 9B, the cross section of the upper part of the coupling of the lower and upper sleeve section is shown. When the sleeve sections 40, 50 are detached, the lower sleeve portion 50 is removed; the row of fasteners 45 is contained within the space between fold section 65 and cover section 75. The cover section 75 is shown extending under and past the row of fasteners 45 in the upper, short sleeve section 40. With the lower, long sleeve section 50 detached, the cover section 75 extends under and covers the row of fasteners 45 within the interior of upper sleeve portion 40. In further instances the cover section 75 can also be located exterior to the juncture of the upper and lower sleeve portions 40, 50 and the juncture of the fasteners 45, 55 occur on the exterior of sleeve portion 40. The cover section 75 can then be folded over the exposed fastener or attachment device 45 and then the fold section 65 be left under the attachment or fasteners 45, essentially reversing the embodiment shown. Both instances result in cover portions that provide a layer of fabric to protect against contact with the infant or child's skin, shown as being folded over the row of fasteners 45 providing a clean line to the garment and protection against chaffing in the figure.

The embodiments and examples discussed herein are non-limiting examples. The invention is described in detail with respect to exemplary or preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. A baby garment having a crotch entry section, the baby garment comprising:

a torso section coupled to the crotch entry section;

a first tubular arm sleeve section with an at least one first sleeve section attachment element forming a lower, long sleeve detachable portion on the garment;

a second tubular arm sleeve section forming an upper, short sleeve extending from the torso section on the garment with an at least one second sleeve section fastener element that selectively couples with the at least one first sleeve section fastener element on the lower, long sleeve section to form a fastener device that selectively attaches the lower, long sleeve detachable portion to the upper, short sleeve portion;

a fold section extending from a distal end of the second tubular arm sleeve section beyond the at least one fastener element on the lower, long sleeve section; and an additional fold section extending from a distal end of the first tubular arm sleeve section or extending from within the second, upper tubular arm section, wherein in a first configuration the the long sleeve detachable portion on the garment is coupled to the short sleeve portion by the mating of the respective at least one fastener elements on each sleeve portion and additional fold section extends from the first tubular sleeve section forming the lower, long sleeve portion into an inside of the second tubular arm sleeve section forming an upper, short sleeve or from within an inside of the second, upper tubular arm section so that the additional fold extends under the fastening element on the lower sleeve section and protect the baby from chafing by contact with the fastening element and in a second configuration, the long sleeve detachable portion is detached from the short sleeve portion by detaching the corresponding fastener element on the long sleeve portion from the corresponding fastener element on the short sleeve portion and the fold section which is in its extended state from the distal end of the second tubular arm sleeve is folded so that the fold section covers the at least one fastener element on the upper, short sleeve section.

2. The baby garment of claim 1, wherein the at least one fastener element on the first sleeve section is on an inside of the first sleeve section and the at least one fastener element on the second sleeve section is on an outside of the second sleeve section.

3. The baby garment of claim 2, wherein the fold section extending from the distal end of the second tubular arm sleeve section extends beyond the distal end of the second tubular arm sleeve section to provide a portion of the fold section that further folds as a further fold section over the end of the second tubular arm section and back into the inside of the second tubular arm section.

4. The baby garment of claim 3, wherein the at least one fastener element on the first sleeve section is on an outside of the first sleeve section and the at least one fastener element on the second sleeve section is on an inside of the second sleeve section.

5. The baby garment of claim 3, wherein the fold section includes an at least one stitch line defining the further fold section that further folds into the tubular arm sleeve section, and providing for folding of the portion of the fold section that further folds into the tubular arm sleeve section on the stitch line.

6. The baby garment of claim 1, wherein the at least one fastener element on the upper sleeve portion includes a first row of fastener elements located on a portion of the second sleeve section above the fold section and a second row of fastener elements located on the fold section and wherein when the second configuration is engaged the fold section is further folded onto the second sleeve section in the second configuration, the first row of fastener elements on the upper sleeve portion mating with the second row of fastener elements on the second sleeve portion and retains the fold section in a folded state.

7. The baby garment of claim 1, wherein the at least one fastener element on the first sleeve section is an at least one snap fastener element and the at least one fastener element on the second sleeve section is an at least one snap fastener element such that the respective at least one snap fastener elements are corresponding mating snap fastener elements.

8. The baby garment of claim 1, wherein the at least one fastener element on the first sleeve portion is an at least one hook and loop fastener element and the at least one fastener element on the second sleeve portion is an at least one hook and loop fastener element, wherein the respective at least one hook and loop fastener elements are corresponding mating hook and loop fastener elements.

9. The baby garment of claim 1, wherein the fold section is folded such that the fold section in the second configuration is atop an outer portion of the second sleeve section.

10. The baby garment of claim 9, further comprising a further fold or cover section, wherein the fold section is covered by the further fold or cover section.

11. The baby garment of claim 10, further comprising an at least one further second sleeve section fastener element, wherein the fold section in the second configuration is folded so that the at least one second sleeve section fastener element on the fold section is coupled to the at least one further second sleeve section fastener element.

12. The baby garment of claim 9, wherein the fold section includes a further extended fold section and the further extended fold section folds over the fold section and both the further extended fold section and the fold section are folded over the outer portion of the second sleeve section.

13. The baby garment of claim 1, wherein the fold section is folded such that the fold section is folded inside the upper, second sleeve section, atop an inner portion of the second sleeve section.

14. The baby garment of claim 13, further comprising a further fold or cover section, wherein the fold section is covered by the further fold or cover section upon folding into the second sleeve section.

15. The baby garment of claim 14, further comprising a third set of fastener elements, wherein after folding the fold section the fold section is coupled to the third set of fastener elements.

16. The baby garment of claim 13, wherein the fold section includes a further extended fold section and the further extended fold section folds over the fold section and both the further extended fold section and the fold section are folded under the inner portion of the second sleeve section.

17. The baby garment of claim 1, further comprising a further fold section and a cover section, wherein in the second configuration the fold section is folded into the cover section and the further fold section extends beyond an end of the fold section and the further fold section is folded over and onto an outside portion of second sleeve section.

18. The baby garment of claim 1, further comprising a further fold section and a cover section, wherein in the second configuration the cover section folds down over the fold section and covers the fold section and the further fold section extends beyond an end of the fold section and the further fold section is folded over and onto an inside portion of the second sleeve section.

19. The baby garment of claim 1, further comprising a further fold and a cover section with an extended additional further fold section, wherein in the second configuration the cover section with the extended additional further fold section extends beyond the cover section and folds over the end of the fold section and under and into the second sleeve portion.

20. The baby garment of claim 1, wherein the fold section extends over the at least one second sleeve section fastener device and a cover section that extends from within an inside section of the second, short sleeve section under an at least one second sleeve section fastener device, such that in said first configuration the at least one first sleeve section fastener device and at least one second sleeve section fastener device are coupled between the fold section and the cover section and in said second configuration the at least one second sleeve section fastener device is covered by the fold section and the cover section.

* * * * *